US010912394B1

(12) United States Patent
Young

(10) Patent No.: US 10,912,394 B1
(45) Date of Patent: Feb. 9, 2021

(54) BABY CARRIER SYSTEM HAVING A SELECTIVELY CHANGEABLE WAIST STRAP

(71) Applicant: Mary Elizabeth Young, South Jordan, UT (US)

(72) Inventor: Mary Elizabeth Young, South Jordan, UT (US)

( * ) Notice: Subject to any disclaimer, the term of this patent is extended or adjusted under 35 U.S.C. 154(b) by 0 days.

(21) Appl. No.: 16/512,898

(22) Filed: Jul. 16, 2019

(51) Int. Cl.
*A47D 13/02* (2006.01)

(52) U.S. Cl.
CPC ..... *A47D 13/02* (2013.01)

(58) Field of Classification Search
CPC ..... A47D 13/02; A47D 13/025; A47D 15/00; A47D 15/005
See application file for complete search history.

(56) References Cited

U.S. PATENT DOCUMENTS 2,550,851 A * 5/1951 Nichols ..... A47D 13/025 224/577
4,836,428 A * 6/1989 Evans ..... A45C 1/04 224/240
4,986,458 A * 1/1991 Linday ..... A47D 13/025 224/160
5,678,739 A * 10/1997 Darling ..... A47D 13/025 224/158
6,045,018 A * 4/2000 Onishi ..... A47D 13/025 224/158
6,415,969 B1 * 7/2002 Higuchi ..... A47D 13/025 224/159
7,252,214 B2 * 8/2007 Krogh ..... A47D 13/025 224/158
8,272,546 B2 9/2012 Leistensnider
8,701,949 B1 * 4/2014 Lehan ..... A45F 3/047 224/160
2019/0133339 A1 * 5/2019 Gibbons ..... A47D 13/025
2019/0313810 A1 * 10/2019 Sauer ..... A47D 13/025

OTHER PUBLICATIONS

Berndt, Bemjamin , "Which Rookie carrier is right for you?—Rookie Premium and Rookie Revolution in comparison", Sep. 19, 2019, available at <https://rookie-baby.com/blogs/news/choosing-the-right-baby-carrier-rookie-revolution-premium?lang=en>.

* cited by examiner

*Primary Examiner* — Derek J Battisti
(74) *Attorney, Agent, or Firm* — Dentons Durham Jones Pinegar; Sarah W. Matthews

(57) ABSTRACT

A baby carrier system is described, which beneficially includes a selectively changeable waist strap. The baby carrier may generally comprise a main panel and a waist support portion at the bottom of the main panel or connected to the bottom of the main panel. The waist support portion may be generally hollow or include an opening for receiving a selectively changeable waist strap. The hollow or opening may include one or more connectors configured to mate with a connector on the selectively changeable waist strap. In use, the connectors may be attached to the selectively changeable waist strap within the hollow or opening and then the connectors may be disengaged to allow the selectively changeable waist strap to be removed and replaced by another waist strap.

13 Claims, 3 Drawing Sheets

BABY CARRIER SYSTEM HAVING A SELECTIVELY CHANGEABLE WAIST STRAP

TECHNICAL FIELD

The present invention relates generally to a baby or child carrier having a waist strap that is worn around the caregiver's waist. More specifically, the present invention relates to a baby carrier having a selectively changeable waist strap.

BACKGROUND

Many child carriers are available which allow a caregiver to carry a child and still have use of their hands. Many of such carriers have a waist strap that fits around a caregiver's waist to carry some of the child's weight around the waist/hips instead of entirely on the caregiver's shoulders. Such carriers often have bulky waist straps with substantial amounts of padding which may result in an unpleasing aesthetic. Some carriers have a more low-profile design, but the caregiver must often choose between a buckle-type closure for the waist strap (which may be formed of plastic and enable ease of use, for example, through metal detectors when traveling, etc.) or a ring-type closure for the waist strap (which may be more aesthetically pleasing to some users compared to a plastic buckle).

Thus, there is a need for a baby carrier which have a selectively changeable waist strap. It may also be advantageous if the baby carrier allows for simple and easy changing of the waist strap.

SUMMARY OF INVENTION

A baby or child carrier system is described herein, comprised of a main panel, the main panel forming a child carrying area in cooperation with a wearer's torso, the main panel having a bottom. A waist support portion may be attached to the bottom of the main panel, with the waist support portion having a front side and a back side, the front side and back side of the waist support portion connected at a top and at a bottom of the waist support portion, thus forming a hollow portion or an opening between the top and the bottom of the waist support portion.

According to one aspect, at least one connector may be attached to the hollow portion. At least one waist strap may be provided for selectively passing through the hollow portion or opening, the at least one waist strap having at least one mating connector to selectively attach to the at least one connector of the hollow portion of the waist support portion.

In some configurations, the opening or hollow portion comprises a right end and a left end with each of the right end and the left end of the hollow portion having at least one connector attached thereto. In other configurations, there may be more connectors, such as a total of four connectors with two connectors on each of the right end and left end. The connectors may pass through the back side of the waist support portion and into the hollow portion or opening. In some configurations, the connectors may comprise, for example, mating discs of snap fasteners.

According to another aspect, at least two waist straps may be provided for selectively connecting to the child carrier. Any suitable type of waist strap may be provided. For example, a waist strap comprised of a webbing and a plastic buckle may be provided, as well as a waist strap comprised of an elongated piece of fabric and at least two rings. Each of the waist straps may comprise mating connectors for selective attachment to the connectors of the waist support portion.

According to another aspect, a child carrier system may comprise a main body portion and a selectively changeable waist strap. The main body portion comprises a main panel, the main panel forming a child carrying area in cooperation with a wearer's torso, the main body portion further comprising a waist support portion, the waist support portion comprising an opening for receiving the selectively changeable waist strap. The child carrier system may also comprise means for attaching the waist support portion to the selectively changeable waist strap.

In some configurations, the selectively changeable waist strap may an engaged position for use around a user's waist when the means for attaching the waist support portion to the selectively changeable waist strap is engaged, and a free position when the means for attaching the waist support portion to the selectively changeable waist strap is not engaged. The selectively changeable waist strap may be removed from the opening in the free position, and may not be removed from the opening in the engaged position.

The selectively changeable waist strap may comprise a first waist strap and a second waist strap. For example, a first waist strap may comprise a webbing with a plastic buckle attached thereto and a second waist strap may comprise an elongated piece of fabric with at least two rings attached thereto.

According to one aspect, the selectively changeable waist strap comprises a first portion to be positioned within the opening of the waist support portion and a second portion to be positioned outside the opening when in use around a user's waist. The first portion to be positioned within the opening may include at least a first and a second mating connectors for connecting to the waist support portion. Similarly, the waist support portion may include connectors to mate with the at least first and second mating connectors of the first portion of the waist strap.

In some configurations, the means for attaching the waist support portion to the selectively changeable waist strap comprises two snap fasteners on a left side of the waist support portion, two snap fasteners on a right side of the waist support portion, and four mating snap fasteners on the waist strap.

According to yet another aspect, a method for carrying a child in a carrier is disclosed, the method comprising the steps of selecting a child carrier system as described above with a first waist strap and a second waist strap; selecting the first waist strap; inserting the first waist strap into the hollow portion of the waist support portion; and attaching the at least one connector of the hollow portion to the at least one mating connector of the first waist strap.

In some configurations the method may also include the steps of detaching the at least one connector of the hollow portion from the at least one mating connector of the first waist strap, and removing the first waist strap from the hollow portion of the waist support portion. The method may also include the steps of: selecting the second waist strap; inserting the second waist strap waist strap into the hollow portion of the waist support portion; and attaching the at least one connector of the hollow portion to the at least one mating connector of the second waist strap.

These and other configurations are shown and described in additional detail below.

BRIEF DESCRIPTION OF DRAWINGS

The following drawings illustrate what are currently considered to be specific representative configurations for carrying out the invention and are not limiting as to embodiments which may be made in accordance with the present invention. The components in the drawings are not necessarily to scale relative to each other. Like reference numerals designate corresponding parts throughout the several views.

The drawings are illustrative and not limiting of the scope of the invention which is defined by the appended claims. The various elements of the invention accomplish various aspects and objects of the invention. Not every element of the invention can be clearly displayed in a single drawing, and as such not every drawing shows each element of the invention.

DETAILED DESCRIPTION

Figure 1:
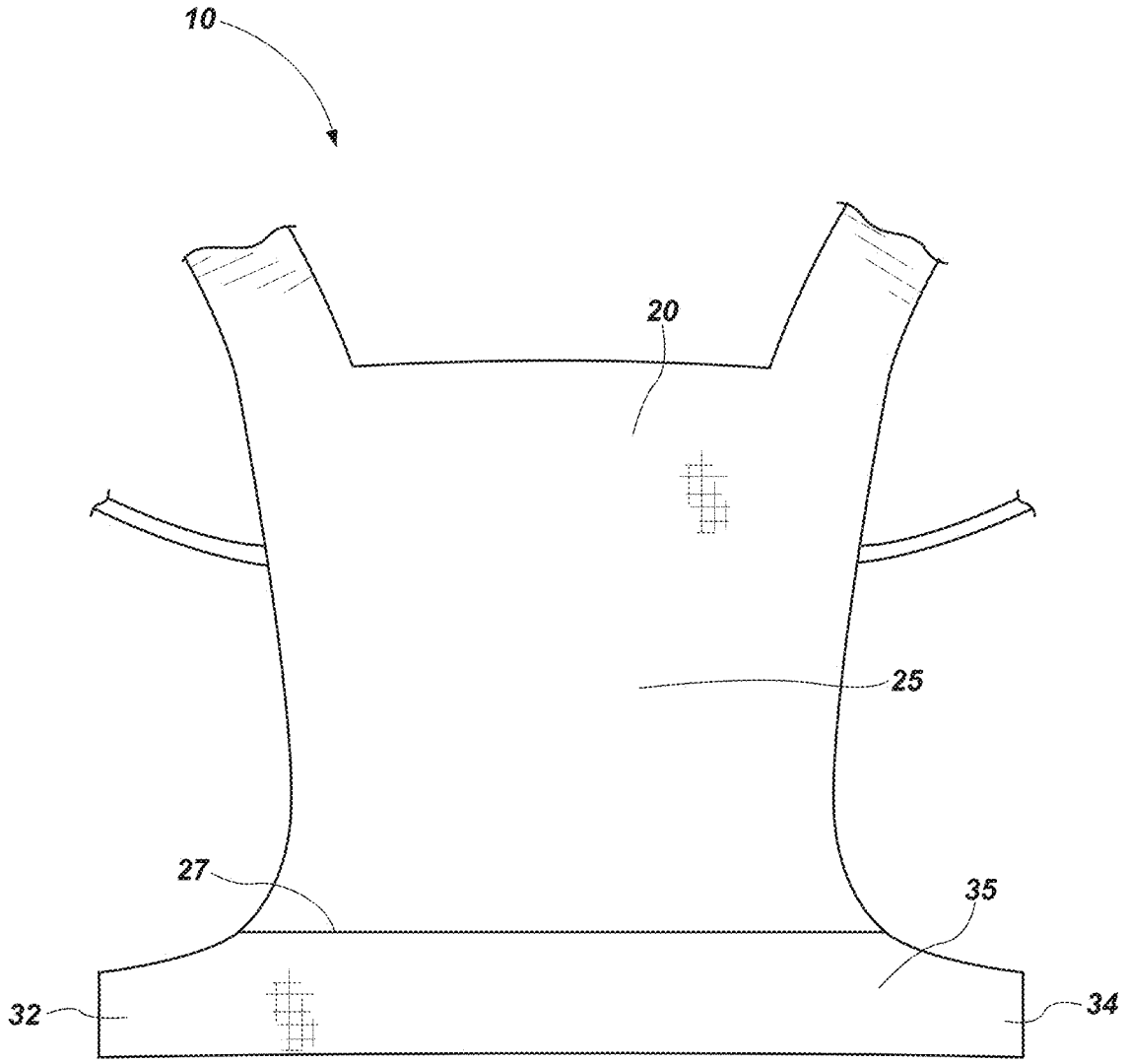
FIG. 1 is a plan view of the front side of a baby carrier without a selectively changeable waist strap.

The following provides a detailed description of particular embodiments of the present invention. Reference will now be made to the drawings in which the various elements of the illustrated configurations will be given numerical designations and in which the invention will be discussed so as to enable one skilled in the art to make and use the invention. It is to be understood that the following description is only exemplary of the principles of the present invention, and should not be viewed as narrowing the scope of the claims which follow, which claims define the full scope of the invention.

Various aspects discussed in one drawing may be present and/or used in conjunction with the embodiment shown in another drawing, and each element shown in multiple drawings may be discussed only once. For example, in some cases, detailed description of well-known items or repeated description of substantially the same configurations may be omitted. The reason is to facilitate the understanding of those skilled in the art by avoiding the following description from being unnecessarily redundant. The accompanying drawings and the following description are provided in order for those skilled in the art to fully understand the present disclosure, and these are not intended to limit the gist disclosed in the scope of claims.

It should be noted that the description merely illustrates the principles of the present subject matter. It will thus be appreciated that those skilled in the art will be able to devise various arrangements that, although not explicitly described herein, embody the principles of the present subject matter and are included within its spirit and scope. Furthermore, all examples recited herein are principally intended expressly to be only for pedagogical purposes to aid the reader in understanding the principles of the invention and the concepts contributed by the inventor(s) to furthering the art, and are to be construed as being without limitation to such specifically recited examples and conditions. Moreover, all statements herein reciting principles, aspects, and embodiments of the invention, as well as specific examples thereof, are intended to encompass equivalents thereof.

Reference in the specification to "one configuration" "one embodiment," "a configuration" or "an embodiment" means that a particular feature, structure, or characteristic described in connection with the configuration is included in at least one configuration, but is not a requirement that such feature, structure or characteristic be present in any particular configuration unless expressly set forth in the claims as being present. The appearances of the phrase "in one configuration" in various places may not necessarily limit the inclusion of a particular element of the invention to a single configuration, rather the element may be included in other or all configurations discussed herein.

Furthermore, the described features, structures, or characteristics of configurations of the invention may be combined in any suitable manner in one or more configurations. In the following description, numerous specific details are provided, such as examples of products or manufacturing techniques that may be used, to provide a thorough understanding of configurations of the invention. One skilled in the relevant art will recognize, however, that configurations of the invention may be practiced without one or more of the specific details, or with other methods, components, materials, and so forth. In other instances, well-known structures, materials, or operations are not shown or described in detail to avoid obscuring aspects of the invention.

The present disclosure is not limited to any particular structures, process steps, or materials discussed or disclosed herein, but is extended to include equivalents thereof as would be recognized by those of ordinary skill in the relevant art. More specifically, the invention is defined by the terms set forth in the claims. Terminology herein is used for the purpose of describing particular aspects of the invention only and is not intended to limit the invention to the aspects or configurations shown unless expressly indicated. Likewise, the discussion of any particular aspect of the invention is not to be understood as a requirement that such aspect is required to be present apart from an express inclusion of the aspect in the claims.

It should also be noted that, as used in this specification and the appended claims, singular forms such as "a," "an," and "the" may include the plural unless the context clearly dictates otherwise. Thus, for example, reference to "a connector" may include one or more of such connectors, and reference to "the selectively changeable waist strap" may include reference to one or more of such selectively changeable waist straps.

As used herein the term "generally" refers to something that is more of the designated adjective than not, or the converse if used in the negative. For example, something maybe said to be generally elongate even though it has a somewhat substantial width rather than being completely elongate.

As used herein, the term "about" is used to provide flexibility to a numerical range endpoint by providing that a given value may be "a little above" or "a little below" the endpoint while still accomplishing the function associated with the range.

As used herein, a plurality of items, structural elements, compositional elements, and/or materials may be presented in a common list for convenience. However, these lists should be construed as though each member of the list is individually identified as a separate and unique member.

Sizes, proportions and other numerical data may be expressed or presented herein in a range format. It is to be understood that such a range format is used merely for convenience and brevity and thus should be interpreted flexibly to include not only the numerical values explicitly recited as the limits of the range, but also to include all the individual numerical values or sub-ranges encompassed within that range as if each numerical value and sub-range is explicitly recited. As an illustration, a numerical range of "about 1 to about 5" should be interpreted to include not only the explicitly recited values of about 1 to about 5, but also include individual values and sub-ranges within the indicated range. Thus, included in this numerical range are individual values such as 2, 3, and 4 and sub-ranges such as from 1-3, from 2-4, and from 3-5, etc., as well as 1, 2, 3, 4, and 5, individually. This same principle applies to ranges reciting only one numerical value as a minimum or a maximum. Furthermore, such an interpretation should apply regardless of the breadth of the range or the characteristics being described.

The present invention generally relates to baby carrier that allows the user to selectively change the waist strap. Although the carrier is generally referred to herein as a "baby" carrier because it is often used to carry babies, the term "baby" is used for ease of references and is not limiting. The carrier can be used to carry infants, babies, toddlers, and children, and "baby" as used herein refers to infants, babies, toddlers, children, etc., who may be carried in the carrier.

As used herein, the term "front side" refers to the side of the baby carrier of which a majority is seen by a third person viewing the baby carrier as it is worn on a caregiver. As used herein, the term "back side" refers to the side of the baby carrier which substantially faces the caregiver as they wear the baby carrier.

Figure 2:
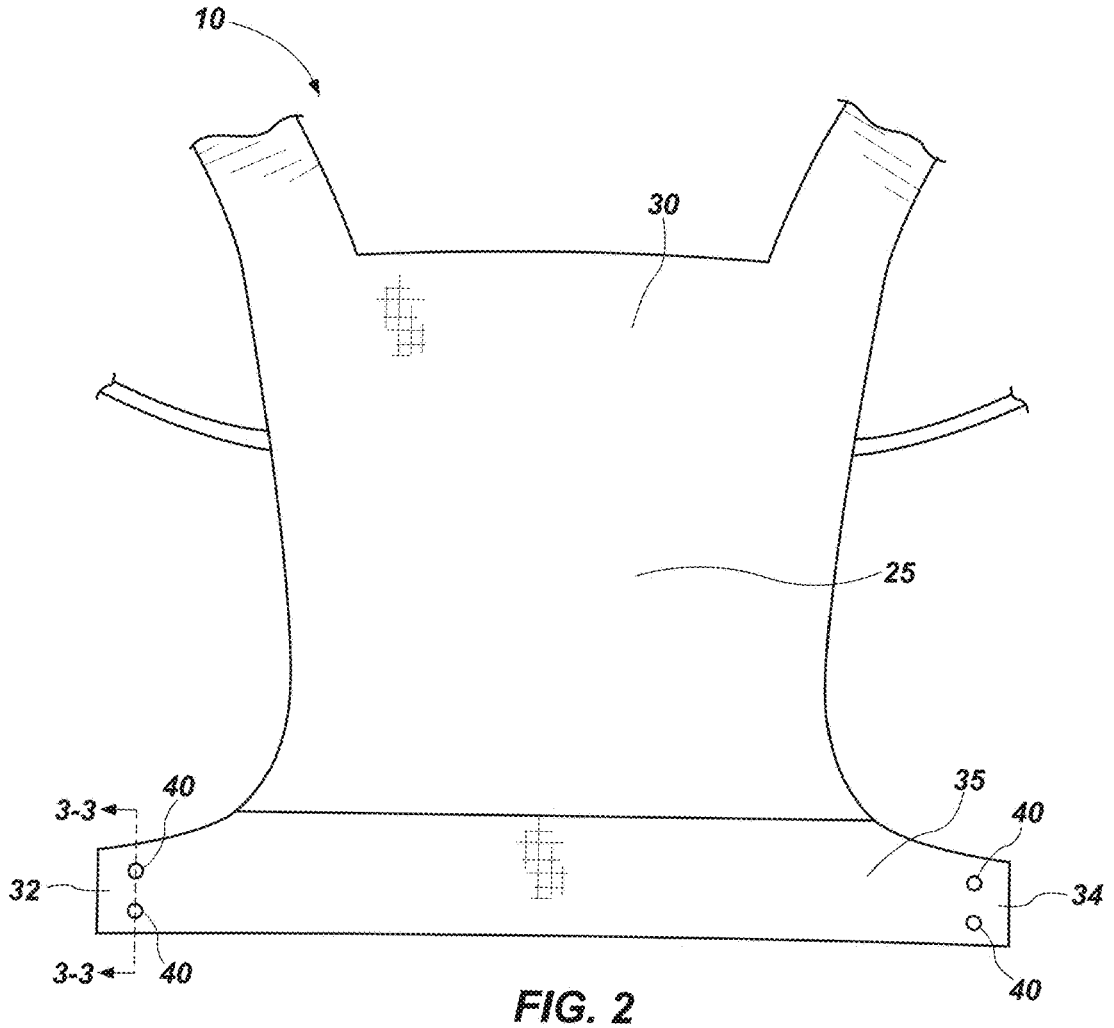
FIG. 2 is a plan view of the back side of a baby carrier of FIG. 1.

One embodiment of the present disclosure is shown and described in the baby carrier of FIG. 1. FIG. 1 is a plan view of a baby carrier, generally indicated at 10, without a connected waist strap, as seen from the front side 20. FIG. 2 is a plan view of a baby carrier, generally indicated at 10, without a connected waist strap, as seen from the back side 30. The baby carrier may generally include a main panel 25, and a waist support portion 35 connected to the bottom 27 of the main panel 25. The main panel 25 forms an area to carry a child in cooperation with a caregiver or wearer's torso.

The waist support portion 35 connected to the bottom 27 of the main panel may include a generally hollow portion or an opening (38 in FIG. 3) to receive a waist strap. In use, a waist strap is passed through the hollow portion or opening 38 of waist support portion 35 and secured, such that the waist strap and the waist support portion 35 form together a continuous band around the user's waist to hold at least some of the weight of the infant, baby, toddler, or child being carried, on the hips of the caregiver or user. Other connections may also be used, besides an opening in the waist support portion for a waist strap. For example, the waist support portion and the waist strap may be zipped together, snapped together with snap-fit connectors, etc.

The waist support portion 35 may also include one or more connectors 40 for securely connecting the selected waist strap to the waist support portion 35. (The selected waist strap may have mating connectors for mating with the connectors of the waist support portion, as discussed in more detail below.) Such connectors may be any suitable connectors known in the art, such as snap-buttons, standard buttons, hook-and-eye, Velcro, buckles, hook-and-loop, toggle fasteners, grommets/eyelets, ties, etc. A snap fastener (or press stud, popper, snap, etc.) may also be used. The snap fastener may comprise a pair of interlocking discs, with a circular lip under one disc which fits into a groove on the top of the other disc, holding them fast until an amount of force is applied. All of the foregoing connectors may be formed of plastic, metal, or other suitable materials known in the art. In other configurations, waist strap and/or waist support portion need not be provided with connectors. That is, in some configurations, the means for attaching the waist support portion to the selectively changeable waist strap may comprise only the hollow or opening of the waist support portion that allows the selectively changeable waist strap to be threaded through. In other configurations, the means for attaching the waist support portion to the selectively changeable waist strap may comprise one or more connectors in addition to the hollow or opening of the waist support portion that allows the selectively changeable waist strap to be threaded through.

Figure 3:
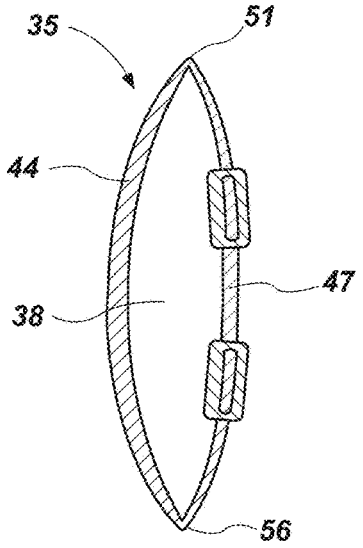
FIG. 3 is a cross-sectional view of the waist support portion of the baby carrier of FIGS. 1 and 2 taken along line 3-3 of FIG. 2.

In the configuration shown in FIGS. 1-3, two sets of two connectors 40 are provided, two connectors on the left side 32 of the waist support portion of the carrier (left being taken from the front side view) and two connectors on the right side 34 of the waist support portion of the carrier. The connectors may be connected to the hollow portion or opening 38 either from the front side or from the back side. In FIG. 2, it can be seen that for this configuration the connectors 40 are attached from the back side 30 of the carrier to the hollow portion or opening 38. The connectors 40 may also be attached only to the inside of the hollow 38 such that they are not visible from the front side or back side. For ease of use in locating the connectors, connectors attached and visible from the back side 30 of the carrier may be used in some configurations.

FIG. 3 shows a cross-sectional view of the waist support portion 35 of the carrier 10 of FIGS. 1-2, still without a waist strap in place, taken from line 3-3 of FIG. 2, to show the hollow portion 38 for receiving a waist strap. The waist support portion 35 includes a front side 44 and a back side 47, with the front side 44 and back side 47 both attached at the top 51 to the main panel 25 of the baby carrier 10. The front side 44 and back side 47 are also attached to one another at the bottom 56. (Any suitable attachment between the front side 44, back side 47, and main panel 25 that creates a hollow portion or opening 38 for receiving a waist strap may be used. For example, only the front side 44 may be connected to the main panel 25, with the back side sewn or otherwise connected directly at its top and bottom to the front side to create the hollow portion or opening 38 for receiving a waist strap.)

Between the top attachment 51 and the bottom attachment 56, a hollow portion or opening 38 is formed. This hollow portion 38 may be configured to receive numerous types of waist straps. The front side 44 and/or back side 47 of the waist support portion 35 may also include the connectors 40 described above to selectively connect to one or more waist straps. The connectors 40 may also be attached directly inside the hollow portion 38 and not extend through to the front side or back side of the waist support portion.

Figure 4:
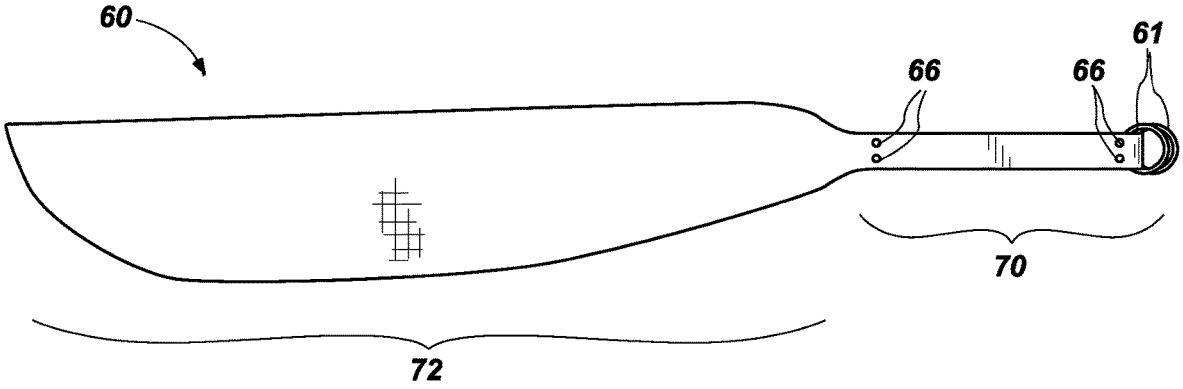
FIG. 4 is a plan view of a waist strap.
Figure 5:
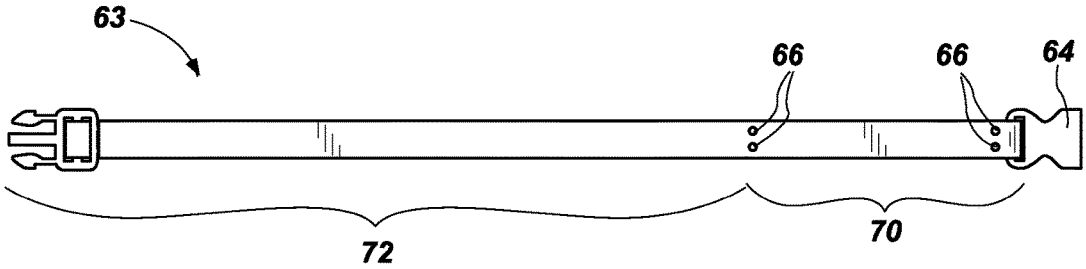
FIG. 5 is a plan view of another configuration of a waist strap.
Figure 6:
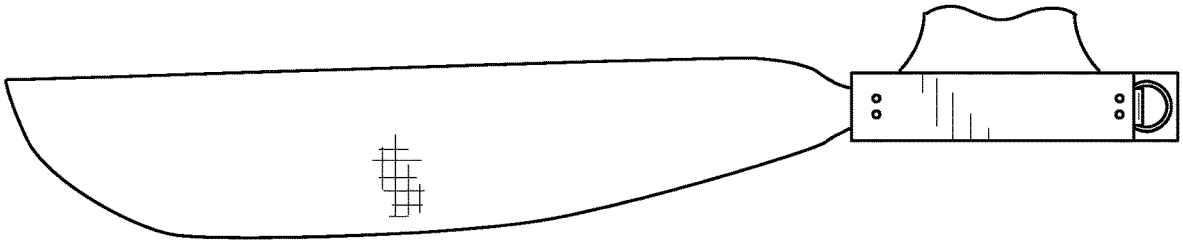
FIG. 6 is a partial view of the back side of the waist support portion of the baby carrier of FIGS. 1-2 with the waist strap of FIG. 4 in place.
Figure 7:
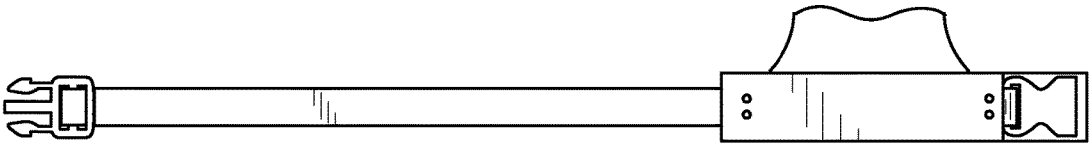
FIG. 7 is a partial view of the back side of the waist support portion of the baby carrier of FIGS. 1-2 with the waist strap of FIG. 5 in place.

FIGS. 4-5 illustrate two exemplary types of waist straps which may be selectively connected to a baby carrier 10. FIG. 4 shows a waist strap 60 comprised of an elongated piece of fabric and at least two rings 61. FIG. 5 shows a waist strap 63 comprised of a webbing and a plastic buckle 64. Each waist strap may include one or more mating connectors 66 to selectively attach to the at least one connector of the hollow portion or opening 38 of the waist support portion 35. The waist straps 60, 63, may also comprise a portion 70 to be positioned within the opening or hollow portion 38 of the waist support portion 35, and a second portion 72 to be positioned outside the opening or hollow portion 38 of the waist support portion 35. The mating connectors 66 may be located on the portion 70 to be positioned within the hollow or opening 38 of the waist support portion 35. FIG. 6 shows a partial view of the back side of the carrier with the waist strap 60 in place through the hollow portion or opening 38 of the waist support portion 35. FIG. 7 shows a partial view of the back side of the carrier with the waist strap 63 in place through the hollow portion or opening 38 of the waist support portion 35. The specific waist straps shown in FIGS. 4-5 are for illustration only, as nearly any time of waist strap may be used (such as a piece of fabric without any buckles or rings that is tied, etc.).

In use, a caregiver or user may first decide which type of waist strap they would like to use with the baby carrier. For example, if the caregiver is going to be traveling with the baby and desires the ease of use of a plastic buckle, the caregiver may select a waist strap having a plastic buckle (such as the waist strap 63 or another similar waist strap). The caregiver then slides the selected waist strap through the hollow of the waist support portion of the carrier. The caregiver then securely attaches the selected waist strap to the waist support portion by connecting the connector(s) 40 of the waist support portion to the mating connector(s) 66 of the waist strap. For example, the caregiver may attach one or more connectors on the left side of the waist support portion and/or one or more connectors on the right side of the waist support portion.

The caregiver then attaches the carrier around their waist via the selected waist strap, such as by snapping the plastic buckle to its mating connector. The caregiver then places the baby in the desired position (such as on their back or on their chest, with the baby facing inwardly or outwardly). The caregiver then lifts the carrier up and around the baby, and places each of their arms through the shoulder straps. The caregiver may then attach one or more buckles at their back to connect the shoulder straps, and adjust the shoulder straps, waist strap, etc., as necessary.

When the caregiver desires to change the waist strap, for example, if the caregiver is going to be wearing more formal clothing or merely desires a change, the caregiver first takes the carrier off and detaches the connector(s) 40 of the waist support portion from the mating connector(s) 66 of the waist strap. The caregiver then slides the newly selected waist strap, such as waist strap 60 with an elongated piece of fabric and one or more rings, through the hollow or opening 38 of the waist support portion 35 of the carrier. The caregiver then securely attaches the selected waist strap to the waist support portion by connecting the connector(s) 40 of the waist support portion to the mating connector(s) 66 of the waist strap. For example, the caregiver may attach one or more connectors on the left side of the waist support portion and/or one or more connectors on the right side of the waist support portion.

The caregiver then attaches the carrier around their waist via the selected waist strap, such as by snapping the plastic buckle to its mating connector. The caregiver then places the baby in the desired position (such as on their back or on their chest, with the baby facing inwardly or outwardly). The caregiver then lifts the carrier up and around the baby, and places each of their arms through the shoulder straps. The caregiver may then attach one or more buckles at their back to connect the shoulder straps, and adjust the shoulder straps, waist strap, etc., as necessary.

The various embodiments described above, including elements of the various embodiments described above, can be combined to provide further embodiments. All of the U.S. patents, U.S. patent application publications, U.S. patent applications, foreign patents, foreign patent applications and non-patent publications referred to in this specification and/or listed in the Application Data Sheet are incorporated herein by reference, in their entirety. Aspects of the embodiments can be modified, if necessary to employ concepts of the various patents, applications and publications to provide yet further embodiments.

These and other changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled.

The invention claimed is:

1. A child carrier system comprising: a main panel, the main panel forming a child carrying area in cooperation with a wearer's torso, the main panel having a bottom and a width extending from a left side edge of the main panel to a right side edge of the main panel; a waist support portion, the waist support portion having a top and a bottom, and a front side and a back side, a left side edge and a right side edge, the top of the waist support portion attached to the bottom of the main panel along the width of the main panel, the top of the waist support portion extending along with width of the bottom of the main panel, and the front side and back side of the waist support portion connected at the top and at the bottom of the waist support portion, forming a hollow portion between the top and the bottom of the waist support portion and between the front side and back side of the waist support portion, the hollow portion extending along the width of the main panel from the left side edge of the main panel to the right side edge of the main panel, the hollow portion having an exterior face and an interior face; at least one waist strap for selectively passing through the hollow portion, the at least one waist strap comprising: a first end and a second end, and a length extending between the first end and the second end, and an attachment means for connecting the first end to the second end of the at least one waist strap; and means for removably connecting the at least one waist strap to the waist support portion, the means for removably connecting the at least one waist strap to the waist support portion comprising: a first connector facing the interior face of the hollow portion, the first connector attached to the hollow portion of the waist support portion proximal to the left side edge of the waist support portion and extending through the back side of the waist support portion; a second connector facing the interior face of the hollow portion, the second connector attached to the hollow portion of the waist support portion proximal to the right side edge of the waist support portion and extending through the back side of the waist support portion; a first mating connector attached to the length extending between the first end and the second end of the at least one waist strap, the a first mating connector attachable to the first connector facing the interior face of the hollow portion of the waist support portion; and a second mating connector attached to the length extending between the first end and the second end of the at least one waist strap, the second mating connector attachable to the second connector facing the interior face of the hollow portion of the waist support portion.

2. The child carrier system of claim 1, further comprising a third connector attached to the hollow portion proximal to the left side edge of the waist support portion, and a fourth connector attached to the hollow portion proximal to the right side edge of the waist support portion.

3. The child carrier system of claim 2, wherein the first, second, third, and fourth connectors comprises connectors that pass through the back side of the waist support portion and into the hollow portion to face the interior face of the hollow portion.

4. The child carrier system of claim 1, wherein the first connector comprises a first disc of a snap fastener, the second connector comprises a first disc of a second snap fastener, and wherein the first mating connector comprises a mating disc of the snap fastener and the second mating connector comprises a mating disc of the second snap fastener.

5. The child carrier system of claim 1, wherein the waist strap comprises at least two waist straps.

6. The child carrier system of claim 5, wherein the at least two waist straps comprise a first waist strap comprised of a webbing and wherein the attachment means for connecting the first end to the second end comprises a plastic buckle; and a second waist strap comprised of an elongated piece of fabric and wherein the attachment means for connecting the first end to the second end comprises at least two rings.

7. The child carrier system of claim 1, wherein the at least one waist strap comprises a first waist strap and a second waist trap.

8. The child carrier system of claim 7, wherein the first waist strap comprises a webbing with a plastic buckle attached thereto.

9. The child carrier system of claim 7, wherein the second waist strap comprises an elongated piece of fabric with at least two rings attached thereto.

10. The child carrier system of claim 2, further comprising: a third mating connector attached to the length extending between the first end and the second end of the at least one waist strap, the third mating connector attachable to the third connector facing the interior face of the hollow portion of the waist support portion; and a fourth mating connector attached to the length extending between the first end and the second end of the at least one waist strap, the fourth mating connector attachable to the fourth connector facing the interior face of the hollow portion of the waist support portion.

11. The child carrier system of claim 2, wherein the first, second, third, and fourth connectors comprise connectors that pass through the front side of the waist support portion and into the hollow portion to face the interior face of the hollow portion.

12. The child carrier system of claim 1, wherein the first and second connectors comprise connectors that pass through the back side of the waist support portion and into the hollow portion to face the interior face of the hollow portion.

13. The child carrier system of claim 1, wherein the first and second connectors comprise connectors that pass through the front side of the waist support portion and into the hollow portion to face the interior face of the hollow portion.

* * * * *